United States Patent [19]

Killen

[11] Patent Number: 4,908,899

[45] Date of Patent: Mar. 20, 1990

[54] GOLF CLUB CLEANING TOOL

[76] Inventor: Donald Killen, 1074 Navajo Rd., Pebble Beach, Calif. 93953

[21] Appl. No.: 313,593

[22] Filed: Feb. 21, 1989

[51] Int. Cl.[4] ..... A47L 13/02; A63B 57/00

[52] U.S. Cl. ..... 15/105; 15/236.01; 15/236.05; 15/236.09; 273/32 B

[58] Field of Search ..... 15/105, 105.5, 236.01, 15/236.05, 236.09; 273/32 B, 162 D, 162 F; D3/62, 64; D32/46, 47

[56] References Cited

U.S. PATENT DOCUMENTS

| | | | |
|---|---|---|---|
| 193,679 | 9/1962 | Baldwin et al. | D32/47 |
| 3,763,515 | 10/1973 | Voss | 15/105 |
| 4,086,678 | 5/1978 | Torr | 15/236.09 |
| 4,535,987 | 8/1985 | Dikoff | 273/32 B |
| 4,698,870 | 10/1987 | Clark | 15/105.5 |

*Primary Examiner*—Harvey C. Hornsby
*Assistant Examiner*—M. Spisich
*Attorney, Agent, or Firm*—Schroeder, David & Orliss Inc.

[57] ABSTRACT

A tool for cleaning grooves having different cross-sectional profiles formed in the face of golf clubs which may also be used as a ball marker, for tightening cleats and repairing ball marks.

7 Claims, 1 Drawing Sheet

GOLF CLUB CLEANING TOOL

BACKGROUND AND SUMMARY OF THE INVENTION

The present invention relates to tools for cleaning and maintaining golf clubs—both woods and irons. In particular, the present invention provides a tool for cleaning the furrow-like grooves formed in the club faces which typically affect golfer's ability to control the flight profile and landing of his ball.

Grooves in the striking face of golf clubs provide control of spin imparted to a golf club as the golfer strikes the ball. Such spin, in turn, influences the flight profile of the ball, so that a skilled golfer can control, for example, a "hook" or "slice", and stop the ball from rolling off a green with reverse spin.

During use, the grooves collect dirt, bits of grass and other debris, which tends to become embedded in the grooves, thus, reducing their effectiveness. If the grooves are not cleaned regularly, and they become completely filled with such dirt and debris, the golfer will be unable to impart desired spin characteristics on the ball during his game.

The grooves in the club face of golf clubs vary in cross-sectional profile. Referring to FIG. 1, groove A has a flat bottom and vertical sides; groove B has a flat bottom and tapered sides; and, finally, groove C is v-shaped, having no bottom at all. In accordance with rules promulgated by the Professional Golf Association (PGA) and the United States Golf Association (USGA), all grooves in the club faces of golf clubs must be no deeper than 0.020 inches and no wider at the surface of the club face than 0.035 inches.

According to the present invention, a tool for cleaning the grooves in the face of a golf club should have router-like tool tips conforming to the particular groove profile of the club. Moreover, it is desirable to have tool tips conforming to all three types of grooves in the same tool since a golfer may use clubs having different groove profiles. In addition, the tool should be small but include sufficient structure for convenient gripping to provide the leverage necessary for cleaning the grooves.

In another embodiment of the present invention, the tool incorporates two extended tynes for repairing ball marks caused when a golf ball lands on a putting surface of a golf course. In still another embodiment, the tool incorporates spanner wrench tips for replacing or tightening the cleats on golf shoes.

In some embodiments of the present invention, the tool may also be used as a ball marker. Ball markers are used by the golfer when, after his ball has reached the green, he wishes to pick up and examine his ball before putting. In such embodiments, a button-like protrusion, orthogonal to the plane of the tool gripping area is included to prevent the marker from moving after it is placed immediately adjacent to the golf ball as a mark. All embodiments of the present invention may also include a hole for convenient carrying of the tool on keychains and the like.

Other features and advantages of the present invention, in addition to those mentioned above, are described in the following detailed description of the preferred embodiment. The detailed description incorporates the accompanying drawings wherein similarly referenced characters refer to corresponding parts of the invention.

DESCRIPTION OF THE PREFERRED EMBODIMENT

Figure 1:
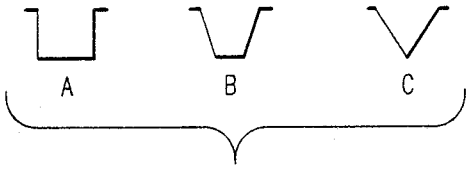
FIG. 1 shows the cross-sections of grooves formed in the club faces of golf clubs in accordance with regulations of the game.
Figure 2:
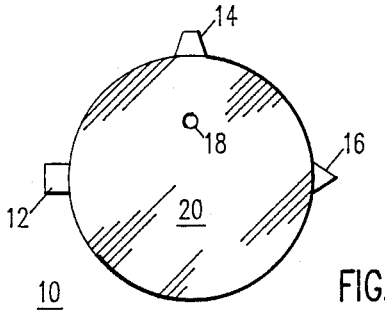
FIG. 2 is a top view of one embodiment of a cleaning tool constructed according to the principles of the present invention.

Referring to FIG. 2, cleaning tool 10 is disc-shaped, incorporating square-groove cleaning tool tip 12, tapered-groove cleaning tool tip 44, and v-groove cleaning tool tip 16. Router-like tool tips 12, 14 and 16 are disposed outwardly from and approximately equidistant around an arc of the periphery of disc 20. Generally, the length and cross-sectional profiles of tool tips 12, 14 and 16 inversely conform to the depth and cross-sectional profiles, respectively, of the grooves in the club faces of golf clubs.

The circular configuration of disc 20 provides necessary gripping area for the user to grip the tool for use while cleaning the grooves of golf clubs. Hole 18 provides convenient means for carrying tool 10 on a keychain or the like.

Tool 10 is approximately $\frac{7}{8}''$ in diameter and approximately 1/16" thick. Constructed typically of injection molded plastic material, such as polycarbonate, polyester and acrylic, tool 10 is one piece, and each tool tip is formed as a homogeneous part of gripping area 20. However, tool 10 my be constructed of any material which may be formed, generally as shown in FIG. 2, and provides the hardness of tool tips 12, 14 and 16 necessary to clean debris from the grooves of golf club faces without excessive wear to either the club face grooves or the tool. Generally speaking, the hardness of tool tips 12, 14 and 16, should slightly exceed the hardness of the material used in the club faces of golf clubs.

Figure 3:
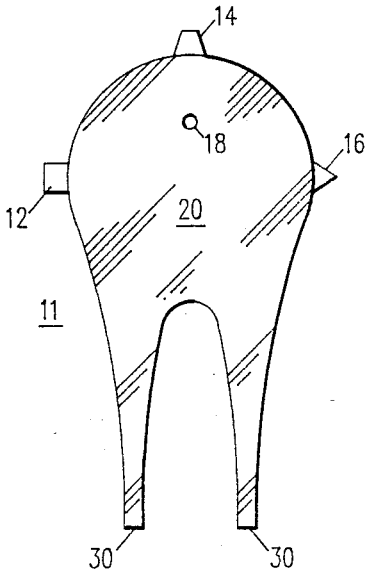
FIG. 3 is a top view of another embodiment of the tool of FIG. 2, incorporating tynes for repairing ball marks.

Referring now to FIG. 3, another embodiment 11 of tool 10 is shown which incorporates suitably spaced-apart ball mark repair tynes 30. Tool 11 is also formed as a one piece article, incorporating gripping area 20 and having approximately the same diameter and thickness as tool 10.

Figure 4:
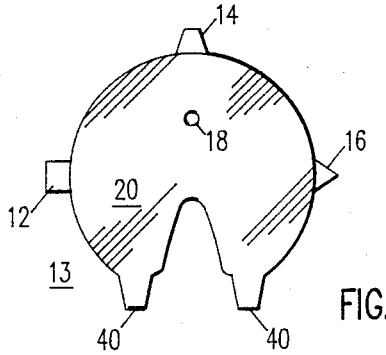
FIG. 4 is a top view of another embodiment of the cleaning tool of FIG. 2 incorporating spanner wrench tips.

Similarly, as shown in FIG. 4, tool 13 is another embodiment of tool 10 which incorporates suitably spaced-apart spanner wrench tips 40 for removing, replacing and tightening the cleats on golf shoes. Tool 13 is similarly a single molded article which provides gripping area 20 having approximately the same diameter and thickness as tool 10.

Figure 5:
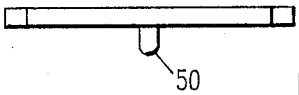
FIG. 5 is a side view of the tool of FIG. 2 showing a ball marker protrusion.

Finally, referring to FIG. 5, protrusion 50 formed on and orthogonal to the surface of gripping area 20 on tool 10, prevents movement of the tool when used as a ball marker on the putting surface of a golf course. Protrusion 50 should be rounded at its tip to avoid discomfort to the user while carrying or using the tool for cleaning club face grooves, but be of sufficient length to prevent casual movement of the tool when used in place as a ball marker.

A golf club cleaning tool constructed according to the preferred embodiment of the present invention has been described by reference herein. While preferred forms and arrangements have been shown illustrating the invention, it is to be understood that various changes in detail and arrangement may be made without departing from the spirit and scope of this invention.

I claim:

1. A tool for cleaning the grooves in the club faces of golf clubs, each of said grooves having a preselected of cross-sectional profile, said tool comprising:

a disc-shaped gripping area;

a plurality of router-like tips, extending outwardly from and along the periphery of the disc-shaped gripping area, each of said tips having a different cross-sectional shape to inversely conform to the cross-sectional profile of each of said grooves.

2. A tool as in claim 1 wherein said plurality of tool tips include:

a first tip for cleaning grooves having a flat bottom and vertical sides;

a second tip for cleaning grooves having a flat bottom and tapered sides;

a third tip for cleaning v-shaped grooves;

3. A tool as in claim 2 further including spaced-apart tines attached to said disc-shaped gripping area for use in repairing ball marks on the greens of golf courses.

4. A tool as in claim 2 further including spaced-apart spanner wrench tips attached to said disc-shaped gripping area for servicing the cleats on golf shoes.

5. A tool as in claim 2 further including a protrusion orthogonal to the plane of the disc-shaped gripping area and extending therefrom for preventing casual movement of said tool when used as a ball marker.

6. A tool as in claim 2 wherein:

said tool is constructed as a single, having homogeneous article; and, said tool is constructed of materials having a hardness slightly greater than the hardness of materials used in constructing the club face of golf clubs.

7. A tool as in claim 2 further including means for attaching said tool to keychains.

* * * * *